United States Patent [19]

Kinast

[11] 3,930,703

[45] Jan. 6, 1976

[54] CENTRAL PLUG CONNECTION

[75] Inventor: Norbert Kinast, Zaiserweiher, Germany

[73] Assignee: Daimler-Benz Aktiengesellschaft, Germany

[22] Filed: June 6, 1974

[21] Appl. No.: 477,047

[30] Foreign Application Priority Data

June 8, 1973 Germany ..... 2229334

[52] U.S. Cl. ..... 339/14 R; 339/18 P

[51] Int. Cl.[2] ..... H01R 3/06

[58] Field of Search ..... 339/14 R, 14 L, 14 P, 18 R, 339/18 B, 18 P, 10, 19

[56] References Cited

UNITED STATES PATENTS 3,384,865 5/1968 Bosworth ..... 339/18 P 3,829,815 8/1974 Rutkowski ..... 339/14 R

*Primary Examiner*—Roy Lake
*Assistant Examiner*—DeWalden W. Jones
*Attorney, Agent, or Firm*—Craig & Antonelli

[57] ABSTRACT

A central plug connection, especially for the connection of diagnostic apparatus in vehicles, in which a frame box consisting of electrically insulating material and equipped with at least one continuous ground rail connected with the vehicle ground is secured in the vehicle; each electrical connecting line coming from individual vehicle aggregates, is provided with a separate plug socket element that is sealingly and disengageably connected by itself at the frame box while the ground and shielding connection of the socket element is electrically connected with the ground rail; a common multi-plug is thereby adapted to be inserted into the sockets of all plug socket elements.

18 Claims, 3 Drawing Figures

CENTRAL PLUG CONNECTION

The present invention relates to a central plug connection, especially for the connection of diagnostic apparatus in motor vehicles.

Many plug connections suitable for this purpose exist already which essentially consist of an insulating part with many inserted or pressed-in contacts, to which are extended and connected as cable trunks the individual connecting lines leading to the aggregates to be examined or tested. During the exchange of the aggregates, the disengagement or disconnection of individual contacts is difficult, is frequently connected with damage to the insulating part and presupposes trained personnel. The exchange of individual broken cables or defective contacts is, for the most part, impossible and can be realized only by a replacement of the entire cable trunk together with a complete plug connection. The plug connections described above of the prior art are, for the most part, not water-tight so that the contacts corrode already after a relatively short period of time. Additionally, the stocking is difficult since the sensitive contacts have to be machanically protected by special synthetic resinous parts.

It is the aim of the present invention to provide a central plug connection which does not entail the aforementioned disadvantages.

The underlying problems are solved according to the present invention in that a frame box consisting of an electrically insulating material and equipped with at least one continuous ground rail connected with the vehicle mass or ground, is secured in the vehicle, in that each of the electrical connecting lines coming from the individual vehicle aggregates is provided with a plug socket element, in that each plug socket element is sealingly and disconnectably connected by itself at the frame box and the ground and shielding connection of the plug socket element is operatively connected in an electrically conductive manner with the ground rail, and in that a common multi-plug is adapted to be inserted into the sockets of all plug socket elements.

Provision is thereby made that the frame box includes a sealing frame for each plug socket element to be secured thereat and in that each plug socket element is surrounded with a seal which seals the plug socket element during the fastening at the frame box with respect to the latter and surrounds the electrical connecting line water-tight on the other side of the plug socket element.

According to a further feature of the present invention, provision is made that each plug socket element is to be secured at the ground rail by means of a screw and that for this purpose, the ground socket of each plug socket element is provided with an internal thread and the ground rail with a bore for each plug socket element.

In one preferred embodiment of the present invention, the ground rail projects at least on one side out of the frame box which is rigidly or securely connected therewith, and is provided with a bore for the fastening of the frame box at the vehicle as well as for the electrical connection of the ground rail with the vehicle ground or mass.

In order to prevent any falsely poled connections, i.e., to prevent an interconnection between improper terminals, each plug socket element is provided with a cam or a groove which engages in a corresponding groove or cam in the sealing frame. In order also not to be able to insert the multi-plug connector in a false or improper manner, such a nut-cam locking arrangement may also be provided between the multi-plug connector and the frame box, or the distance of the first to the second plug socket element may be slightly larger or smaller than between the remaining elements with the same construction of the pin distances in the multi-connector plug.

In all embodiments, provision is made that the frame box is adapted to be closed on the side opposite the plug socket elements by a cover that is seated in a water-tight manner. Furthermore, any sealing frames which are not occupied by a plug socket element are sealed off by a blind element. The stocking and storing of the plug connections according to the present invention offers no difficulties since the plug socket elements which may consist of a unitary, one-piece structure or of two shells, may be stored together with the contacts and the seal as preassembled unit and therefore no contacts project from the same as well as from the other parts and no contacts have to be stored individually.

Accordingly, it is an object of the present invention to provide a central plug connection, especially for the connection of diagnostic apparatus in vehicles, which avoids by simple means the aforementioned shortcomings and drawbacks encountered in the prior art.

Another object of the present invention resides in a central plug connection which minimizes the danger of damage to the insulating parts in case of exchange of any of the aggregates which are connected to the central plug connection.

A further object of the present invention resides in a central plug connection which eliminates the need for highly trained personnel in handling the equipment.

Still a further object of the present invention resides in a central plug connection which makes it possible to interchange individual broken cables or defective contacts without the need of replacing the entire cable trunk.

Another object of the present invention resides in a plug connection of the type described above which is water-tight and thus prevents premature corrosion of the contacts.

Still another object of the present invention resides in a central plug connection which greatly facilitates the storing and stocking of such plug connections and parts thereof.

A further object of the present invention resides in a multi-plug connection for vehicles which is simple in construction, yet precludes a false interconnection of the multi-plug with the multi-socket.

These and further objects, features and advantages of the present invention will become more apparent from the following description when taken in connection with the accompanying drawing which shows, for purposes of illustration only, one embodiment in accordance with the present invention, and wherein.

Figure 1:
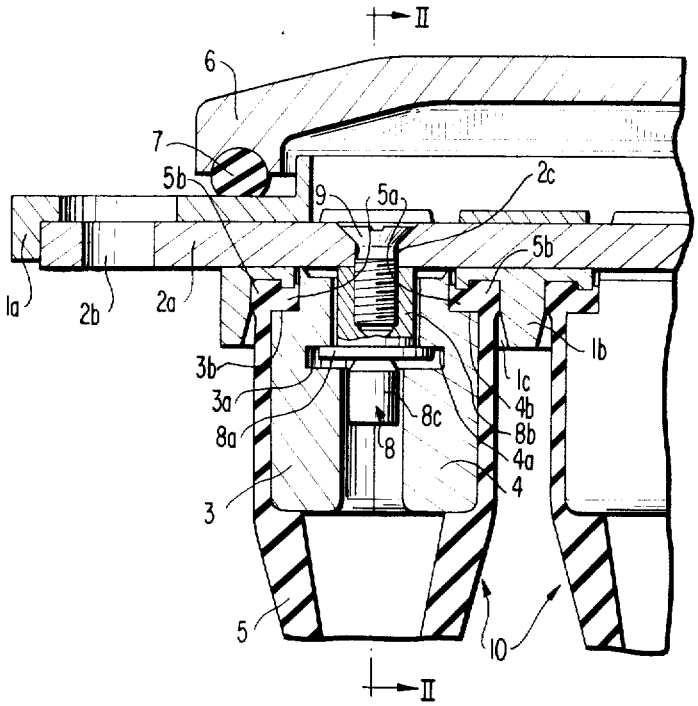
FIG. 1 is a somewhat schematic, partial longitudinal cross-sectional view through a central plug connection in accordance with the present invention, taken along line I—I of FIG. 2.
Figure 2:
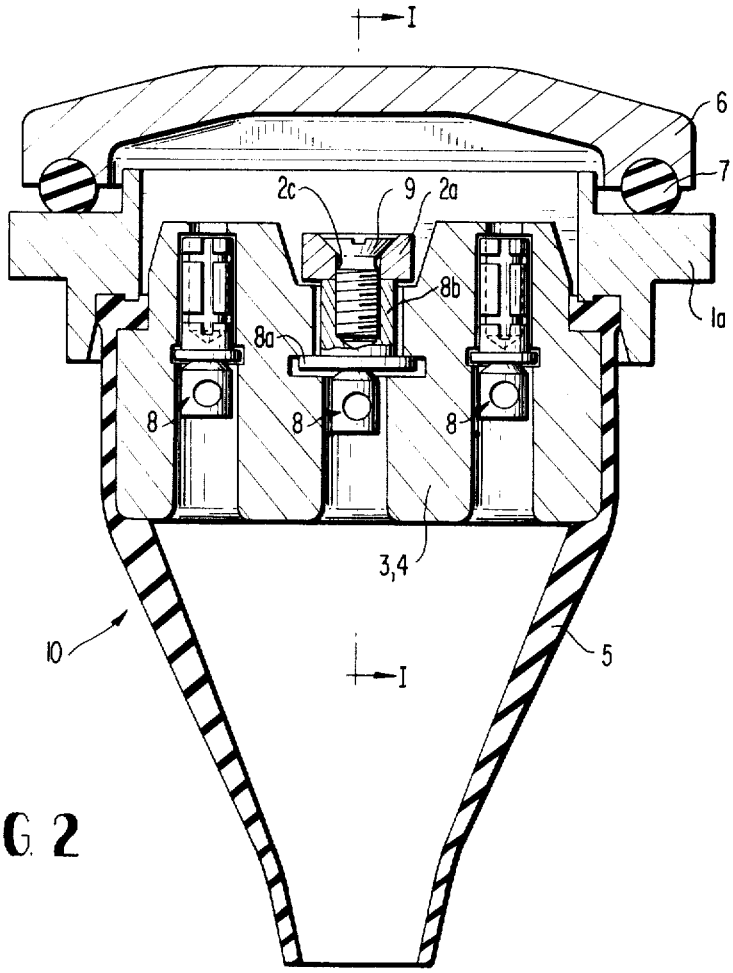
FIG. 2 is a somewhat schematic transverse cross-sectional view, taken along line II—II of FIG. 1.
Figure 3:
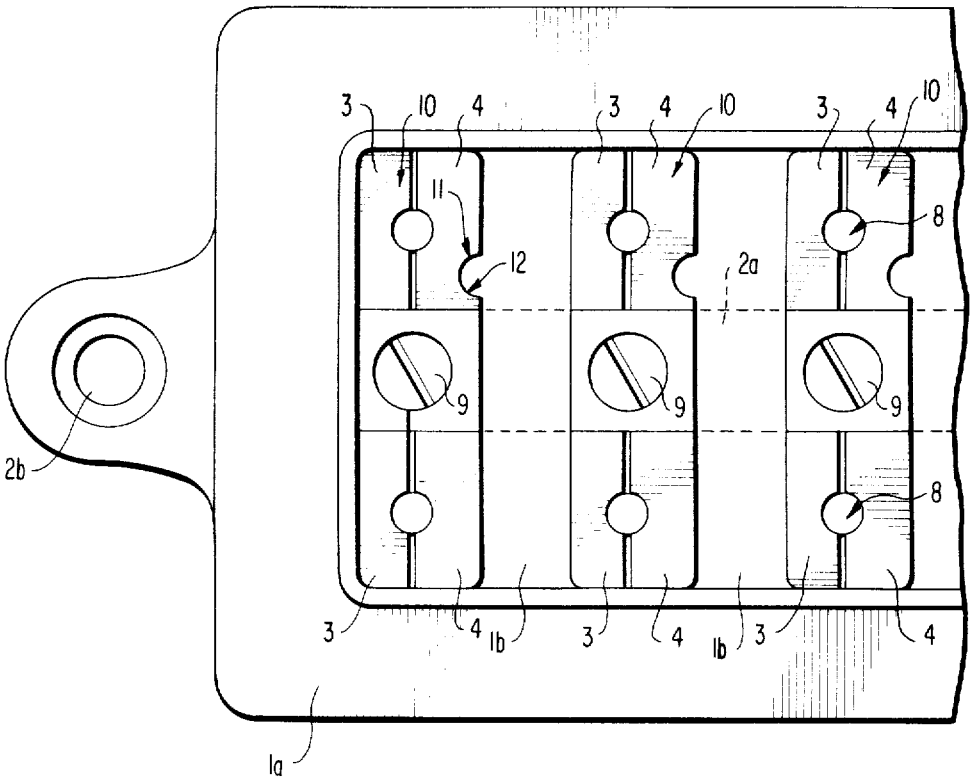
FIG. 3 is a somewhat schematic, partial top plan view on the central plug connection of FIGS. 1 and 2.

Referring now to the drawing wherein like reference numerals are used throughout the various views to designate like parts, reference numerals 1*a* designates in all three figures a frame box which, together with cross webs 1*b* (FIGS. 1 and 3), forms individual sealing frames 1*c*. A ground rail 2*a* is arranged parallel to the longitudinal axis of the central plug connection, which is rigidly connected with the frame box 1*a* in any conventional manner. The ground rail 2*a* projects at both ends out of the sealing frame 1*c* and is provided thereat with bores 2*b* for the mechanical fastening of the sealing frame 1*c* at the vehicle (not shown) as well as for the electrical connection of the ground rail 2*a* with the vehicle mass or ground. Inside of the frame box 1*a* the ground rail 2*a* is provided with bores 2*c*, which are preferably countersunk, for the fastening of the individual plug socket elements generally designated by reference numeral 10. Each plug socket element 10 consists of two half-shells 3 and 4 into which are inserted contacts 8; of these contacts, the center contact 8 which is to be threadably connected with the ground rail 2*a* by means of the screw 9, is provided with an internal thread. The entire plug socket element 10 is surrounded by a seal 5 which during tightening of the element by means of the screw 9 is pressed against the sealing frame 1*c* and securely surrounds on the other side the connecting cable (not shown) leading to the plug socket element. As can be seen from FIGS. 1 and 2, the contact 8 includes a plate-like-enlargement 8*a* intermediate its portion 8*b* provided with the internal thread and its connecting portion 8*c*, properly speaking; the plate-like-enlargement 8*a* thereby abuts against shoulder surfaces 3*a* and 4*a* formed by notches in the shells 3 and 4 so that upon tightening the screw 9, the contact enlargement 8*a* forces the shells 3 and 4 securely against the sealing frame 1*c* by way of the sealing element 5. For that purpose, each shell is provided with a shoulder portion 3*b* and 4*b*, over which extends a corresponding inwardly projecting portion 5*a* of the sealing element which in turn is provided with ribs or the like 5*b* engaging in complementary grooves or channels provided in the sealing frame 1*c*, thereby securely assembling the various parts in a water-tight manner.

From the other side the frame box 1*a* is closed off in a water-tight manner by a cover 6 with a seal 7, which is removed only during a diagnosis for the connection of the multi-plug connector of a diagnostic apparatus. For purposes of a non-interchangeable connection of the plug socket elements 10, the latter are provided with a groove 11 (FIG. 3) while the cross webs 1*b* and/or the frame box 1*a* are provided with cams or lugs 12 at the corresponding places.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A central plug connection, which comprises a frame box means of electrically insulating material and a ground rail means disposed within said frame box means, said ground rail means being adapted to be connected with vehicle ground, wherein electrical connecting lines coming from individual aggregates are provided with a plug socket means, each plug socket means being sealingly and disconnectably connected with the frame box means, said plug socket means including a ground connection electrically connected with said ground rail means, and wherein a common multi-plug is adapted to be inserted into the sockets of all plug socket means.

2. A central plug connection according to claim 1, characterized in that the ground rail means is a continuous, uninterrupted strip.

3. A central plug connection according to claim 1, characterized in that said ground connection includes a ground and shielding connection which is electrically connected with the ground rail means.

4. A central plug connection according to claim 1, characterized in that the central plug connection is adapted to be secured in a vehicle for the interconnection with diagnostic apparatus.

5. A central plug connection according to claim 1, characterized in that the frame box means includes one sealing frame means for each plug socket means to be secured thereat and in that each plug socket means is surrounded by a seal which seals the plug socket means with respect to the frame box means during the fastening thereof at the frame box means and on the other side of the plug socket means surrounds the electrical connecting line in a water-tight manner.

6. A central plug connection according to claim 5, characterized in that each plug socket means is operable to be secured at the ground rail means by a screw, and in that to this end the plug socket means includes a ground socket, each ground socket being provided with an internal thread, and the ground rail means being provided with a bore for each plug socket means.

7. A central plug connection according to claim 6, characterized in that the last-mentioned bore is countersunk for the screw.

8. A central plug connection according to claim 6, characterized in that the ground rail means projects at least on one side out of the frame box means securely connected therewith and is provided with a bore for the fastening of the frame box means at the vehicle as well as for the electrical connection of the ground rail means with said vehicle ground.

9. A central plug connection according to claim 8, characterized in that each plug socket means includes one of cam and groove means which engages in a corresponding one of groove and cam means provided in the sealing frame means.

10. A central plug connection according to claim 9, characterized in that the frame box means is adapted to be closed on the side opposite the plug socket means by a cover seated in a water-tight manner.

11. A central plug connection according to claim 10, characterized in that the ground rail means is a continuous, uninterrupted strip.

12. A central plug connection according to claim 11, characterized in that said ground connection includes a ground and shielding connection which is electrically connected with the ground rail means.

13. A central plug connection according to claim 11, characterized in that the central plug connection is adapted to be secured in a vehicle for the interconnection with diagnostic apparatus.

14. A central plug connection according to claim 1, characterized in that each plug socket means is operable to be secured at the ground rail means by a screw, and in that to this end the plug socket means includes a ground socket, each ground socket being provided with an internal thread, and the ground rail means being provided with a bore for each plug socket means.

15. A central plug connection according to claim 1, characterized in that the ground rail means projects at least on one side out of the frame box means securely connected therewith and is provided with a bore for the fastening of the frame box means at the vehicle as well as for the electrical connection of the ground rail means with said vehicle ground.

16. A central plug connection according to claim 5, characterized in that each plug socket means includes one of cam and groove means which engages in a corresponding one of groove and cam means provided in the sealing frame means.

17. A central plug connection according to claim 1, characterized in that the frame box means is adapted to be closed on the side opposite the plug socket means by a cover seated in a water-tight manner.

18. A central plug connection according to claim 1, characterized in that said ground rail means is arranged parallel to the longitudinal axis of said frame box means.

* * * * *